US007808433B2

(12) United States Patent
Rutfors et al.

(10) Patent No.: US 7,808,433 B2
(45) Date of Patent: Oct. 5, 2010

(54) ANTENNA DEVICE AND PORTABLE RADIO COMMUNICATION DEVICE COMPRISING SUCH AN ANTENNA DEVICE

(75) Inventors: Tomas Rutfors, Holmsund (SE); Axel Von Arbin, Täby (SE)

(73) Assignee: Laird Technologies AB, Kista (SE)

( * ) Notice: Subject to any disclaimer, the term of this patent is extended or adjusted under 35 U.S.C. 154(b) by 50 days.

(21) Appl. No.: 11/573,933

(22) PCT Filed: Sep. 2, 2005

(86) PCT No.: PCT/SE2005/001270

§ 371 (c)(1),
(2), (4) Date: Jan. 11, 2008

(87) PCT Pub. No.: WO2006/031170

PCT Pub. Date: Mar. 23, 2006

(65) Prior Publication Data

US 2008/0246674 A1 Oct. 9, 2008

(30) Foreign Application Priority Data

Sep. 13, 2004 (SE) ..... 0402182

(51) Int. Cl.
*H01Q 1/38* (2006.01)

(52) U.S. Cl. ..... 343/700 MS; 343/702; 343/846

(58) Field of Classification Search ..... 343/876, 343/846, 702, 722, 700 MS, 848
See application file for complete search history.

(56) References Cited

U.S. PATENT DOCUMENTS

| | | | | |
|---|---|---|---|---|
| 6,034,640 | A * | 3/2000 | Oida et al. | 343/722 |
| 6,501,427 | B1 | 12/2002 | Lilly et al. | |
| 6,606,061 | B2 * | 8/2003 | Wong et al. | 343/700 MS |
| 6,624,789 | B1 | 9/2003 | Kangasvieri et al. | |
| 7,084,816 | B2 * | 8/2006 | Watanabe | 343/700 MS |
| 7,199,762 | B2 * | 4/2007 | Liu et al. | 343/702 |
| 7,348,926 | B2 * | 3/2008 | Ueda | 343/702 |
| 2002/0190913 | A1 * | 12/2002 | Kuck | 343/846 |

FOREIGN PATENT DOCUMENTS

EP 1 396 906 A1 3/2004

(Continued)

OTHER PUBLICATIONS

Second Notification of Office Action from the State Intellectual Property Office of China dated Jun. 4, 2010, for Patent Application No. 200580030503.2 (3 pages).
Swedish Office Action dated Feb. 23, 2005, for Patent Application No. 0402182-0 (3 pages).

(Continued)

*Primary Examiner*—Tan Ho
(74) *Attorney, Agent, or Firm*—Harness, Dickey & Pierce, P.L.C.

(57) ABSTRACT

The present invention comprises an antenna device for a portable radio communication device operable in at least a first and a second frequency band. The antenna device comprises a first electrically conductive radiating element having a feeding portion connectable to a feed device (RF) of the radio communication device for feeding and receiving radio frequency signals, a first ground plane portion arranged at a distance from the first radiating element, a second ground plane portion, and a controllable switch arranged between the first and second ground plane portion for selectively interconnecting or disconnecting the first and second ground plane portion.

20 Claims, 2 Drawing Sheets

FOREIGN PATENT DOCUMENTS

| | | | | |
|---|---|---|---|---|
| EP | 1469549 | A1 | * | 10/2004 |
| GB | 2390240 | A | | 12/2003 |
| JP | 10 209733 | | | 8/1998 |
| JP | 2001 053528 | A | | 2/2001 |
| WO | WO 0120718 | A1 | | 3/2001 |
| WO | WO 03069728 | A1 | | 8/2003 |
| WO | WO 2004095633 | | | 11/2004 |

OTHER PUBLICATIONS

Notice of Allowance from the European Patent Office dated Feb. 9, 2010, for European Patent Application No. 05777277.4 (4 pages).
Written Opinion of the International Searching Authority dated Dec. 21, 2005, for Patent Application No. PCT/SE2005/001270 (5 pages).
International Search Report of the International Search Authority dated Dec. 21, 2005, for Patent Application No. PCT/SE2005/001270 (4 pages).

* cited by examiner

ANTENNA DEVICE AND PORTABLE RADIO COMMUNICATION DEVICE COMPRISING SUCH AN ANTENNA DEVICE

FIELD OF INVENTION

The present invention relates generally to antenna devices and more particularly to a controllable internal multi-band antenna device for use in portable radio communication devices, such as in mobile phones. The invention also relates to a portable radio communication device comprising such an antenna device.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones. A type of internal antenna that is often used in portable radio communication devices is the so-called Planar Inverted F Antenna (PIFA).

However, the application of internal antennas in a mobile phone puts some constraints on the configuration of the antenna, such as the dimensions of the radiating element or elements, the exact location of feeding and grounding portions etc. These constraints may make it difficult to find a configuration of the antenna that provides a wide operating band. This is particularly important for antennas intended for multi-band operation, wherein the antenna is adapted to operate in two or more spaced apart frequency bands. In a typical dual band phone, the lower frequency band is centered on 900 MHz, the so-called GSM 900 band, whereas the upper frequency band is centered around 1800 or 1900 MHz, the DCS and PCS band, respectively. If the upper frequency band of the antenna device is made wide enough, covering both the 1800 and 1900 MHz bands, a phone operating in three different standard bands is obtained. In the near future, antenna devices operating four or even more different frequency bands are envisaged.

The number of frequency bands in passive antennas is limited by the size of the antenna. To be able to further increase the number of frequency bands and/or decrease the antenna size, active frequency control can be used. An example of active frequency control is disclosed in the Patent Abstracts of Japan 10190347, which discloses a patch antenna device capable of coping with plural frequencies. To this end there are provided a basic patch part and an additional patch part which are interconnected by means of PIN diodes arranged to selectively interconnect and disconnect the patch parts. Although this provides for a frequency control, the antenna device still has a large size and is not well adapted for switching between two or more relatively spaced apart frequency bands, such as between the GSM and DAMSP and/or DCS and PCS bands.

Instead, this example of prior art devices is typical in that switching in and out of additional patches has been used for tuning instead of creating additional frequency band at a distance from a first frequency band.

The Patents Abstracts of Japan publication number JP2000-236209 discloses a monopole antenna comprising a linear conductor or on a dielectric substrate, see FIG. 1. Radiation parts of the antenna are composed of at least two metal pieces connected through diode switch circuits. The radiation elements have feed points connected to one end of a filter circuit, which cuts of a high-frequency signal. A signal $V_{Switch}$ is used to control the diode switch. The disclosed configuration is limited to monopole or dipole antennas. Also, the object of the antenna according to the above mentioned Japanese document is not to provide an antenna with a small size.

A problem in prior art antenna devices is thus to provide a multi-band antenna of the PIFA type with a small size and volume and broad frequency bands which retains good performance.

SUMMARY OF THE INVENTION

It is a main object of the present invention to provide such apparatus and method that at least alleviate the above problems.

An object of the present invention is to provide an antenna device of the kind initially mentioned wherein the frequency characteristics provides for at least two comparatively wide frequency bands while the overall size of the antenna device is small.

Another object is to provide an antenna device having better multi-band performance than prior art devices.

The invention is based on the realization that several frequency bands can be provided in a physically very small antenna by arranging the antenna so that the effective frequency band for the radiating elements can be controlled by controlling a switch. That is, the radiating elements may be tuned to a first frequency band, or a first set of frequency bands, in a first mode and a second frequency band, or set of frequency bands, in a second mode by operating said switch.

Patent applications SE0301200-2, SE0302979-0, SE0400203-6 filed in Sweden by the same applicant as the present application concerns similar matters as the present invention and are hereby incorporated by this reference. A concurrent application filed Sweden on the same date as the present application by the same applicant also concerns the same area and is hereby also incorporated by this reference.

It has been suggested that the radiating elements should be divided in two parts and connected with a switch to thereby achieve the above purpose. On such switch element may be a diode. Since, however, diodes are not ideal components it has been discovered that they may cause sharp harmonics which may not be tolerated in some standards. The present inventors have discovered that by providing the diode, or switch, on the ground plane, where the currents in the diode are much smaller compared to currents in the diode if provided on the radiating element, these harmonics are not at all as disturbing, and it is easier to design an antenna keeping within limits defined by different standards.

By placing the diode on the ground plane the harmonics created by the currents in the diode are not transmitted because they are trapped by the ground near the excitation.

Thus, there is provided a multi-band antenna device having an antenna volume as small as about 2 $cm^3$ which means that the size of the antenna is remarkably reduced compared to standard multi-band patch antennas but still with maintained or improved RF performance. Also, the bandwidths of the antenna device according to the invention can be improved compared to corresponding prior art devices but without any increase in size, which is believed to be a result of the use of the basic frequency mode of the antenna structure. As an example thereof, bandwidths of as much as 15% of the centre frequency of the higher frequency band have been obtained as compared to 9-10% in conventional prior art antenna devices.

These objects among others are, according to a first aspect of the present invention, attained by an antenna device for a portable radio communication device operable in at least a first and a second frequency band, the antenna device comprises: a first electrically conductive radiating element having a feeding portion connectable to a feed device (RF) of the radio communication device for feeding and receiving radio frequency signals, a first ground plane portion arranged at a distance from the first radiating element, a second ground plane portion, and a controllable switch arranged between the first and second ground plane portion for selectively interconnecting or disconnecting the first and second ground plane portion.

The above objects among others are, according to a second aspect of the present invention, attained by a method for achieving multi-band characteristics for a antenna having at least one radiating element provided above a first and a second ground plane portion, and wherein the radiating element is connected to the first ground plane portion, comprising the steps of:—feeding a radio frequency signal to the radiating element, and—operating a switch provided between the first and second ground plane portions, wherein the switch is open to radio frequency signals in a first mode and closed to radio frequency signals in a second mode, to alter the effective operating frequency band of the antenna.

The above objects among others are, according to a third aspect of the present invention, attained by a portable radio communication device, comprising such an antenna device.

By dividing the ground plane in two parts and connecting these two parts with a switch it is possible to control the configuration of the ground plane and thereby the resonance frequency of the antenna.

According to a variant of the present invention the switch comprises a PIN diode.

According to a variant of the present invention the state of the switch is controlled by means of a control voltage input ($V_{Switch}$).

By using a PIN diode as a switch to state of the switch is easily controllable by providing a voltage input.

According to a variant of the present invention a high pass filter is connected between the first and second ground plane portions, which high pass filter allows the radio frequency signals to pass. This provides for the possibility to have a slit with a controllable length in the ground plane.

According to a variant of the present invention the radiating element is generally planar.

According to a variant of the present invention the first and second ground plane portion are arranged in the same plane having parallel normals. That is, the two ground plane parts are arranged side by side under the radiating element.

According to a variant of the present invention the first and second ground plane means are arranged in a substantially orthogonal relationship with substantial orthogonal normals. That is, the first ground plane portion is provided under substantially the complete radiating element and the second ground plane portion is provided at the side of the first ground plane portion and radiating element.

According to a variant of the present invention the second ground plane means comprises a feeding portion for feeding the control voltage to the switch. The feeding portion is connectable control logic in a radio communication device so that the radio communication device can select which operating mode the antenna should take.

According to a variant of the present invention a filter is provided between the feeding portion for feeding a control voltage to the switch and the second ground plane means. According to a variant of the present invention the filter is a low pass filter blocking signals at frequencies equal to and higher than the lower frequency band of the at least a first and a second frequency bands. This prevents high frequency signals from reaching the control logic connected to the feeding portion.

According to a variant of the present invention the antenna comprises a second radiating element. The radiating element is open for different designs to achieve resonance at the desired frequency.

According to a variant of the present invention the first and/or second radiating element has a configuration that provides for more than one resonance frequency. According to common knowledge it is possible to design a PIFA antenna to be resonant in two different frequency bands. By operating the switch it is therefore possible to achieve an antenna which is working in four different frequency bands.

According to a variant of the present invention the first radiating element comprises a connection to the first ground plane portion.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1 to 5, which are given by way of illustration only, and thus are not limitative of the present invention.

PREFERRED EMBODIMENTS

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

Figure 1:
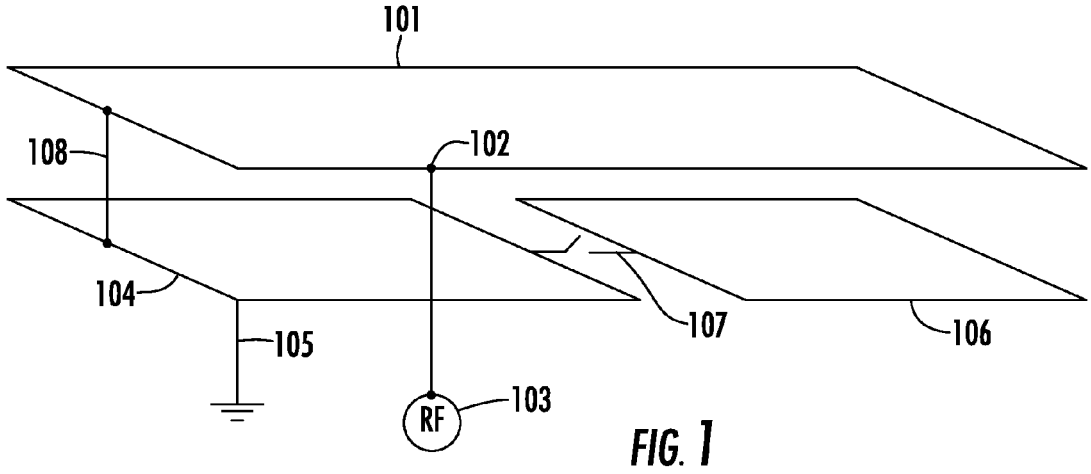
FIG. 1 is a schematic perspective view of a first variant of the present invention comprising a switch.

FIG. 1 is a schematic perspective view of a first variant of the invention showing a radiating element 101 having a feeding point 102 being connectable to a radio frequency signal feed 103, such as a portable radio telecommunication device (not shown). Even though the radiating element 101 is shown as a substantial rectangular sheet it may take other forms to be tuned to the desired frequency band as is much discussed in the prior art. Such forms include U-shape, E-shape, W-shape, a meandering shape or any other suitable shape and may comprise active or passive components. The radiating element 101 may even consist of several parts connected by inductances, capacitances or active components such as diodes. It is however in general planar but may comprise parts being folded to protrude towards the ground plane.

The radiating element 101 is connected 108 to a first ground plane portion 104. The first ground plane portion 104 is commonly connected to the ground of the portable radio telecommunication device, through a ground connection 105. The first ground plane portion is further connected to a second ground plane portion 106 through a switch 107. The antenna is basically a planar inverted F antenna with an adjustable ground plane configuration. When the switch 107 is open the radiating element 101 sees the first ground plane portion 104 as the complete ground plane, but when the switch 107 is closed the radiating element 101 sees the combined first and second ground plane portions 104 and 106 as the complete ground plane. This will affect the position of the resonance frequency or frequencies for the antenna.

Thus by operating the switch 107, the antenna can be switched between two different operating modes. For instance may the antenna be tuned to have two resonance frequencies when the switch is off, such as 850 Mhz and 1800 Mhz, corresponding to the DAMPS and DCS standards, and two other resonance frequencies when the switch is on, such as 900 Mhz and 1900 Mhz, corresponding to GSM and PCS. Thus an antenna is achieved which is capable of communication in four different frequency bands.

Figure 2:
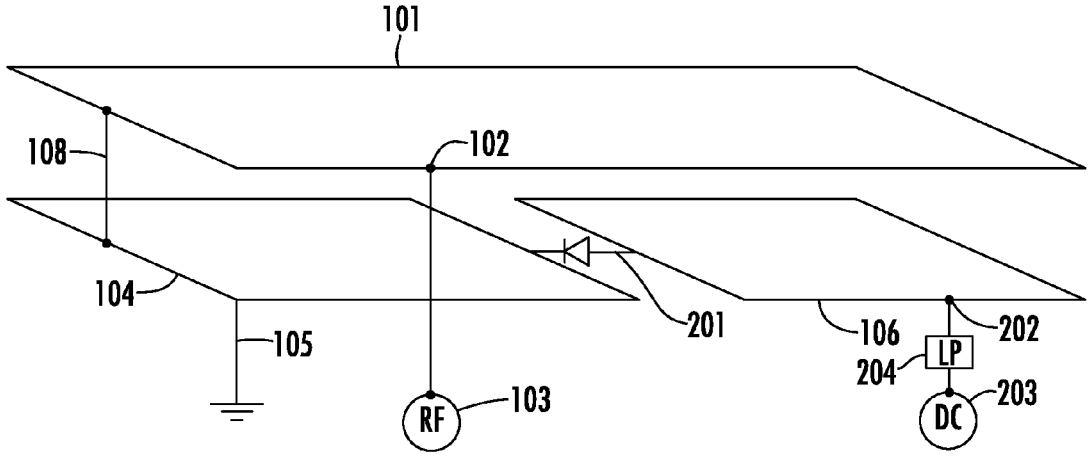
FIG. 2 is a schematic perspective view of a second variant of the present invention wherein the switch is implemented using a diode.

FIG. 2 is a schematic perspective view of a second variant of the present invention where the switch is implemented using a diode 201. Similar details in FIG. 1 and FIG. 2 are denoted with the same reference numerals. The second ground plane portion is provided with a DC feed point 202 connected to a controllable DC feed 203 through a low-pass filter 204. The DC-feed can be controlled to take two different voltages, the first being 0 volt and the second, $V_{switch}$, between 1 and 5 volt. When no voltage is applied to the feed point 202 the diode 201 is open and currents in the first and second ground plane portions 104 and 106 can not travel between the two ground plane portions and thus only the first ground plane portion 104 is connected to the radiating element 101 through the connection 108.

When $V_{switch}$ is applied to the second ground plane portion 106 the diode 201 will open, and basically provide a short-circuit between the first ground plane portion 104 and the second ground plane portion 106. Thus both the first and second ground plane portion will be connected to the radiating element 101 through the connection 108 and the diode 201.

Consequently, it is possible to control the configuration of the ground plane by applying a voltage to the second ground plane means 106, to thereby control the resonance frequency of the antenna.

Figure 3:
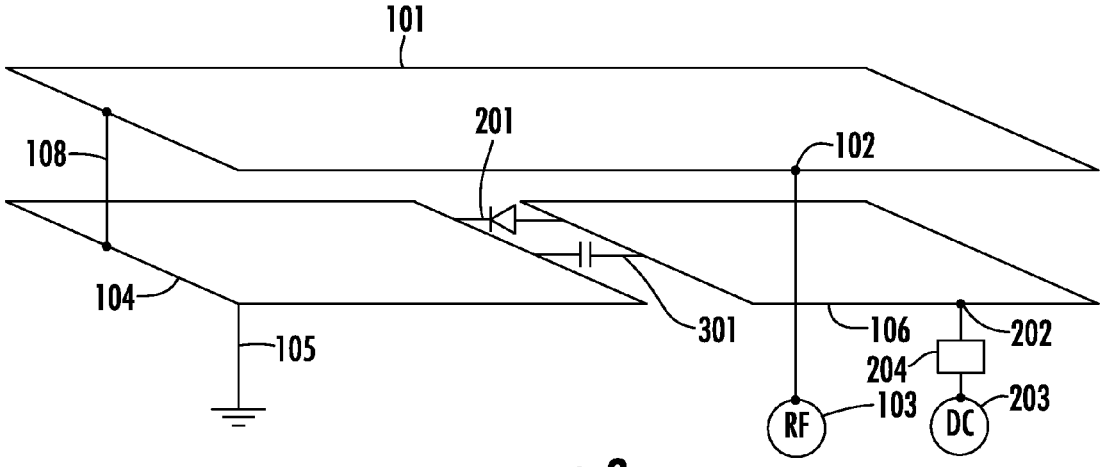
FIG. 3 is a schematic perspective view of a third variant of the present invention wherein the switch is implemented using a diode and where a capacitance is present.

FIG. 3 is a schematic perspective view of a third variant of the present invention. Similar details have been denoted with the same reference numerals as in FIG. 2. In this variant the first and second ground plane portions 104 and 106 are connected with a DC-block 301, such as a capacitor. Thus the first and second ground plane portions are connected for radio frequency signals independently of the mode of the diode 201 through the DC-block, which allows RF signals to pass. This configuration is analog to having a slit in the ground plane and where the size of the slit is controllable through the application of $V_{switch}$.

Figure 4:
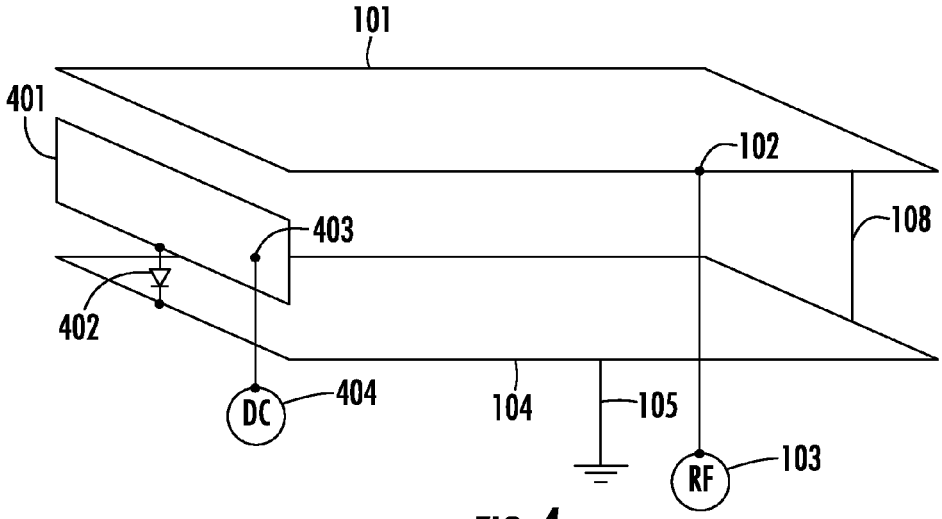
FIG. 4 is a schematic perspective view of a fourth variant of the present invention wherein the switch is implemented using a diode and the ground plane is folded.

FIG. 4 is a schematic perspective view of a fourth variant of the present invention. Similar details have been denoted with the same reference numerals as in FIG. 2. As is clearly visible in FIG. 4 a second ground plane portion 401 is oriented in substantially orthogonal relation to the first ground plane portion 104. A diode 402 connects the first and second ground plane portions and a DC feed point 403 is connected to a DC voltage 404, for providing a voltage $V_{switch}$ to operate the switch 402.

By having the second ground plane portion 401 orthogonally to the first ground plane portion 104, the first ground plane portion can be provided to cover substantially the complete area of the radiating element 101. This is beneficial in that it reduces radiation in the direction of the first ground plane portion 104, which is often in the direction of a human head when the antenna is implemented in a portable radio telecommunication device. Thus this arrangement reduces SAR.

Figure 5:
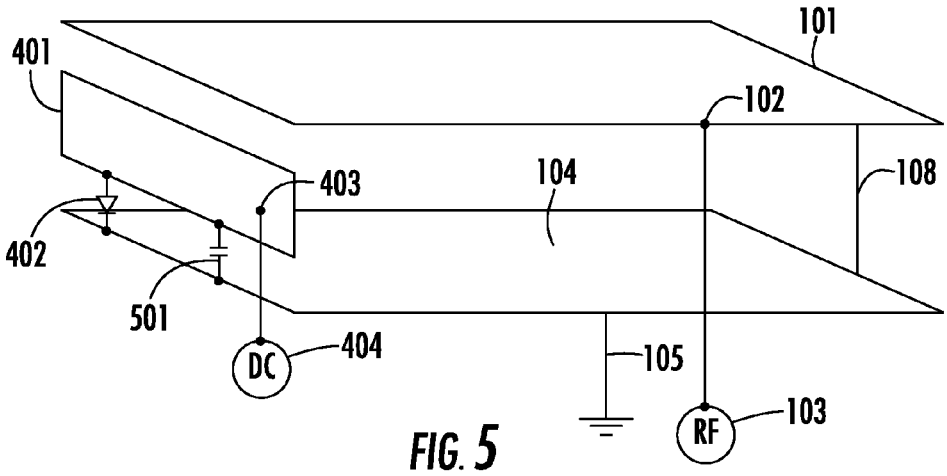
FIG. 5 is a schematic perspective view of a fifth variant of the present invention wherein the switch is implemented using a diode and a capacitor and where the ground plane is folded.

FIG. 5 is a schematic perspective view of a fifth variant of the present embodiment where a DC-block 501, such as a capacitor, is provided between the first and second ground portions, similar to the variant described in connection with FIG. 3. Similar details have been denoted with the same reference numerals as in FIG. 4.

It will be obvious that the invention may be varied in a plurality of ways. The second ground plane portion may for instance be positioned side-by-side with the radiating element, or may have a U-shape so that a first part is parallel with the first ground plane portion and a second part is parallel with the radiating element. Such variations are not to be regarded as a departure from the scope of the invention. All such modifications as would be obvious to one skilled in the art are intended to be included within the scope of the appended claims.

The invention claimed is:

1. An antenna device for a portable radio communication device operable in at least a first and a second frequency band, said antenna device comprising:

a radiating element having a feeding portion connectable to a feed device of said radio communication device for feeding and receiving radio frequency signals;

a first ground plane portion arranged at a distance below said radiating element;

a second ground plane portion;

a high pass filter coupled between said first and second ground plane portions, which high pass filter allows said radio frequency signals to pass thereby forming a configuration that is analog to a ground plane having a slit, and a controllable switch arranged between and directly connected to the first and second ground plane portions for selectively interconnecting or disconnecting said first and second ground plane portions, to alter an effective operating frequency band of said antenna by controlling the slit length between said first and second ground plane portions.

2. The antenna device according to claim 1, wherein the state of the switch being controlled by means of a control voltage input.

3. The antenna device according to claim 2, wherein said second ground plane portion comprises a control voltage feeding portion for feeding said control voltage to said switch.

4. The antenna device according to claim 3, wherein a filter is provided between said feeding portion and said second ground plane portion.

5. The antenna device according to claim 4, wherein said filter is a low pass filter blocking signals at frequencies equal to and higher than the lower frequency band of said at least a first and a second frequency bands.

6. The antenna device according to claim 1, wherein said radiating element is generally planar.

7. The antenna device according to claim 1, wherein said first and second ground plane portions are arranged in the same plane having parallel normals.

8. The antenna device according to claim 1, wherein said first and second ground plane portions are arranged in a substantially orthogonal relationship with substantial orthogonal normals.

9. The antenna device according to claim 1, wherein the controllable switch comprises a PIN diode.

10. The antenna device according to claim 1, wherein said radiating element has a configuration that provides for more than one resonance frequency.

11. The antenna device according to claim 1, wherein said radiating element comprises a connection to said first ground plane portion.

12. The antenna according to claim 1, wherein the antenna is coupled to a portable radio communication device.

13. A portable radio communication device comprising the antenna according to claim 1.

14. The antenna according to claim 1, wherein the radiating element comprises a substantially rectangular sheet.

15. The antenna according to claim 1, wherein the antenna is operable as a planar inverted F antenna with an adjustable ground plane configuration.

16. The antenna according to claim 1, wherein the switch is operable such that:

when the switch is open the radiating element sees the first ground plane portion as the complete ground plane; and when the switch is closed the radiating element sees the combined first and second ground plane portions as the complete ground plane;

whereby the switch enables the antenna to be operable between two different operating modes.

17. The antenna according to claim 1, wherein the antenna is tuned to have two resonance frequencies when the switch is off and two other resonance frequencies when the switch is on, whereby the antenna is capable of communication in four different frequency bands.

18. The antenna according to claim 1, wherein:

said second ground plane is orthogonal to said first ground plane; and said first ground plane covers substantially the complete area of the radiating element, thereby allowing for reduced radiation in the direction of the first ground plane portion.

19. A method for achieving multi-band characteristics for an antenna having at least one radiating element coupled above a first and a second ground plane portion, and wherein said radiating element is connected to said first ground plane portion and a high pass filter is coupled between said first and second ground plane portions, which high pass filter allows radio frequency signals to pass thereby forming a configuration that is analog to a ground plane having a slit, the method comprising:

feeding a radio frequency signal to said radiating element, operating a switch directly connected between said first and second ground plane portions, wherein said switch is open to radio frequency signals in a first mode and closed to radio frequency signals in a second mode, to alter the effective operating frequency band of said antenna by controlling the slit length between said first and second ground plane portions.

20. The method in claim 19, wherein said switch is set into said first mode by providing a first DC-voltage on said second ground plane portion and into said second mode by providing a second DC-voltage on said second ground plane portion.

* * * * *